US010631374B1

(12) United States Patent
Fowler

(10) Patent No.: US 10,631,374 B1
(45) Date of Patent: Apr. 21, 2020

(54) MICROWAVE OVEN

(71) Applicant: Roberta Fowler, Port Orchard, WA (US)

(72) Inventor: Roberta Fowler, Port Orchard, WA (US)

( * ) Notice: Subject to any disclaimer, the term of this patent is extended or adjusted under 35 U.S.C. 154(b) by 311 days.

(21) Appl. No.: 15/846,405

(22) Filed: Dec. 19, 2017

(51) Int. Cl.
*H05B 6/64* (2006.01)
*H05B 6/68* (2006.01)

(52) U.S. Cl.
CPC ..... *H05B 6/6435* (2013.01); *H05B 6/6417* (2013.01); *H05B 6/6441* (2013.01); *H05B 6/687* (2013.01)

(58) Field of Classification Search
CPC .. H05B 6/6435; H05B 6/6417; H05B 6/6441; H05B 6/687
See application file for complete search history.

(56) References Cited

U.S. PATENT DOCUMENTS 8,093,538 B2 1/2012 Claesson
D750,431 S 3/2016 Bergese
9,521,710 B2 12/2016 Li
2009/0044129 A1* 2/2009 Ebrom ..... G06F 8/34 715/738
2009/0044137 A1* 2/2009 Bartley ..... G06F 9/54 715/764
2010/0127606 A1 5/2010 Collene
2012/0060821 A1* 3/2012 McNamee ..... F24C 15/022 126/197
2014/0159877 A1 6/2014 Huang
2015/0282257 A1* 10/2015 Hoare ..... H05B 6/6411 219/719
2016/0057816 A1 2/2016 Alias
2016/0348414 A1* 12/2016 Ivanovic ..... H05B 6/6414

FOREIGN PATENT DOCUMENTS

EP 2708820 A 9/2017

* cited by examiner

*Primary Examiner* — Jeremy Carroll

(57) ABSTRACT

The improved microwave oven comprises modifications to a microwave oven for reducing the noise generated by the microwave oven. The modifications made to the improved microwave oven include: 1) adding a volume control to the control system of the microwave oven to reduce volume of the sounds generated by the microwave oven; 2) adding a pneumatic latch to the microwave oven to reduce the noise generated by the opening and closing of the microwave door; and, 3) providing remote control capability to the microwave oven such that the operation of the microwave oven can be handled remotely from a more noise tolerant environment. The improved microwave oven comprises the microwave oven, a personal data device, and a remote control. The personal data device operates the microwave oven from a remote location. The remote control controls the volume of the sounds generated by the microwave oven from a remote location.

16 Claims, 5 Drawing Sheets

MICROWAVE OVEN

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of electric heating including heating by electric, magnetic, and electromagnetic fields, more specifically, a user interface configured for such a device.

SUMMARY OF INVENTION

The improved microwave oven comprises modifications made to a microwave oven to reduce the noise generated by the microwave oven. The modifications made to the improved microwave oven include: 1) adding a volume control to the control system of the microwave oven to reduce volume of the sounds generated by the microwave oven; 2) adding a pneumatic latch to the microwave oven to reduce the noise generated by the opening and closing of the microwave door; and, 3) providing remote control capability to the microwave oven such that the operation of the microwave oven can be handled remotely from a more noise tolerant environment. The improved microwave oven comprises the microwave oven, a personal data device, and a remote control. The personal data device operates the microwave oven from a remote location. The remote control controls the volume of the sounds generated by the microwave oven from a remote location.

These together with additional objects, features and advantages of the improved microwave oven will be readily apparent to those of ordinary skill in the art upon reading the following detailed description of the presently preferred, but nonetheless illustrative, embodiments when taken in conjunction with the accompanying drawings.

In this respect, before explaining the current embodiments of the improved microwave oven in detail, it is to be understood that the improved microwave oven is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the improved microwave oven.

It is therefore important that the claims be regarded as including such equivalent construction insofar as they do not depart from the spirit and scope of the improved microwave oven. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
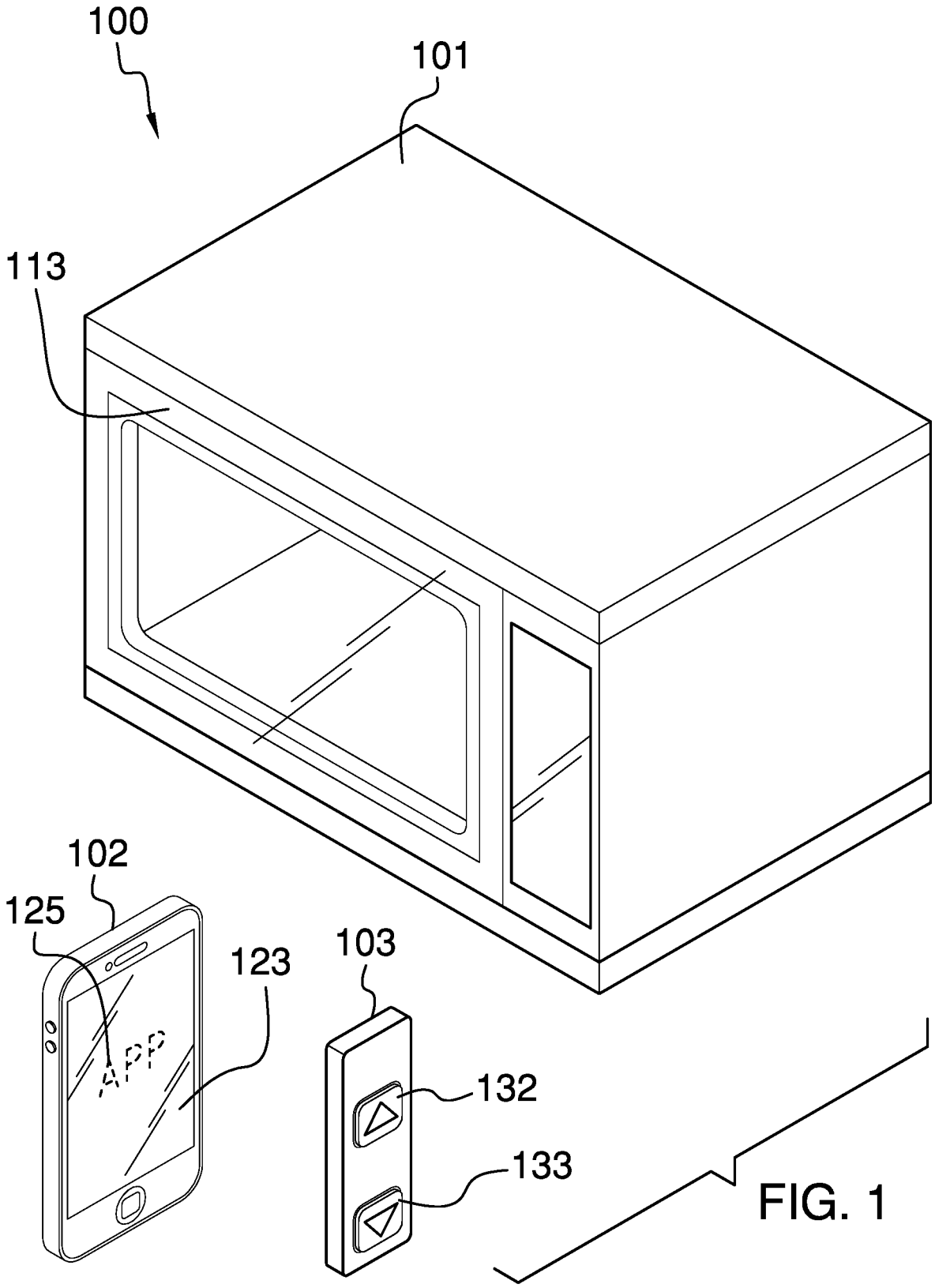
FIG. 1 is a perspective view of an embodiment of the disclosure.
Figure 2:
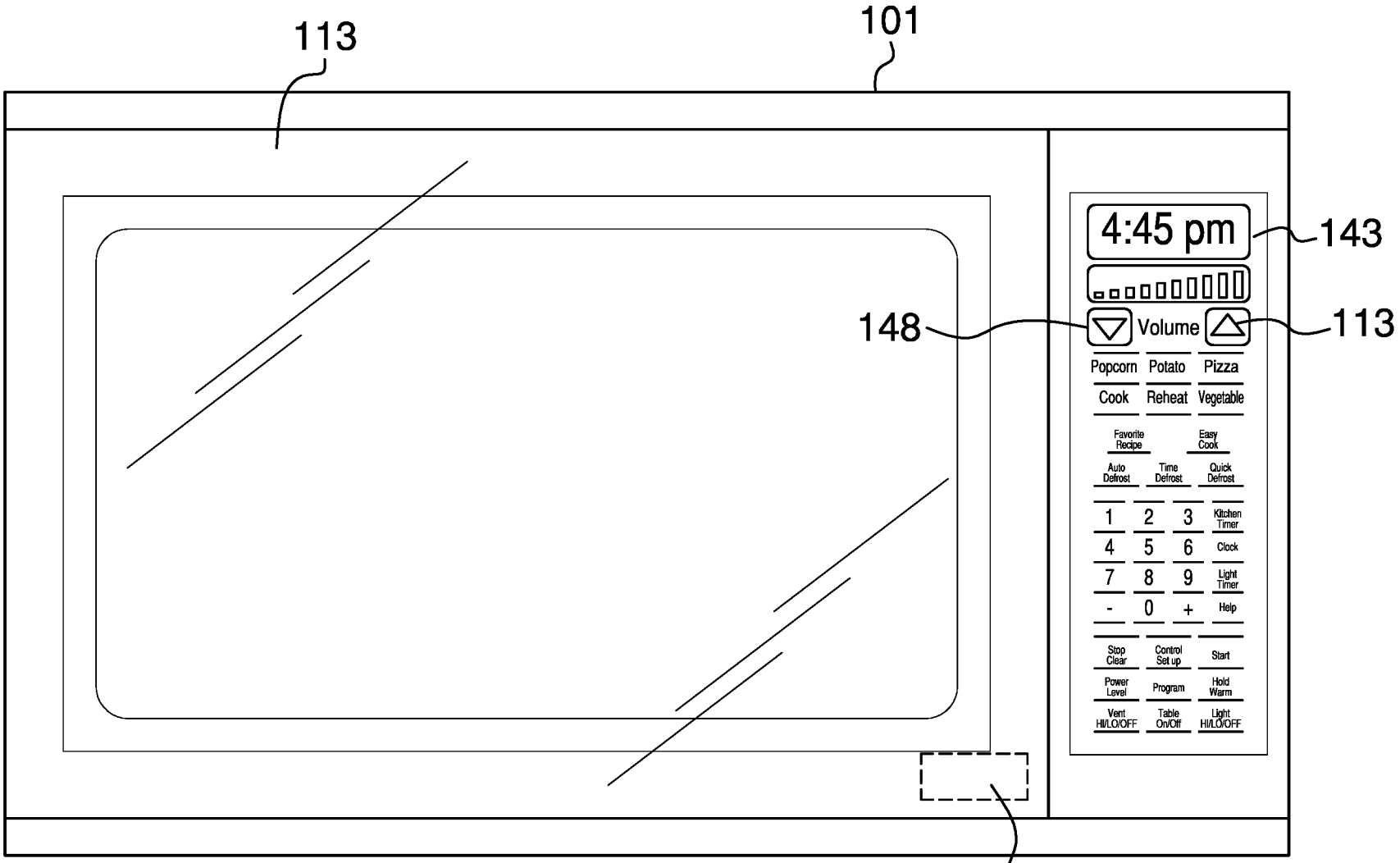
FIG. 2 is a front view of an embodiment of the disclosure.
Figure 3:
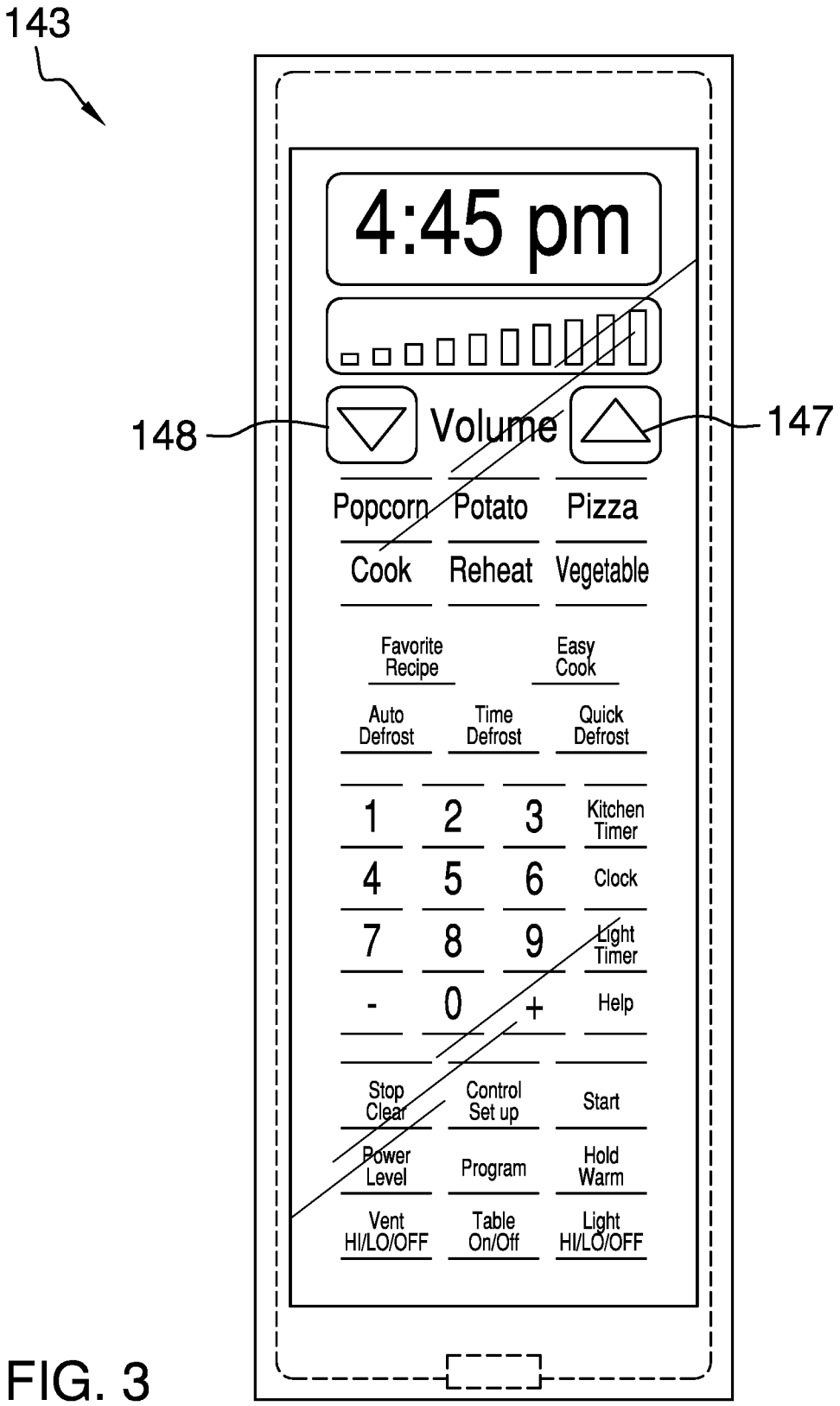
FIG. 3 is a detail view of an embodiment of the disclosure.
Figure 4:
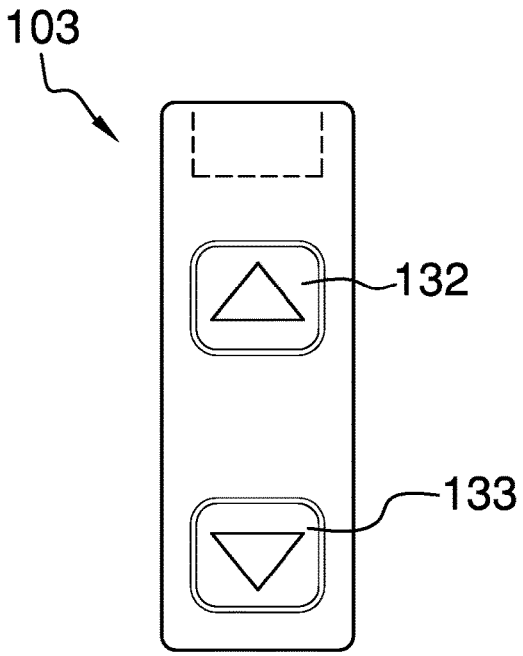
FIG. 4 is a detail view of an embodiment of the disclosure.
Figure 5:
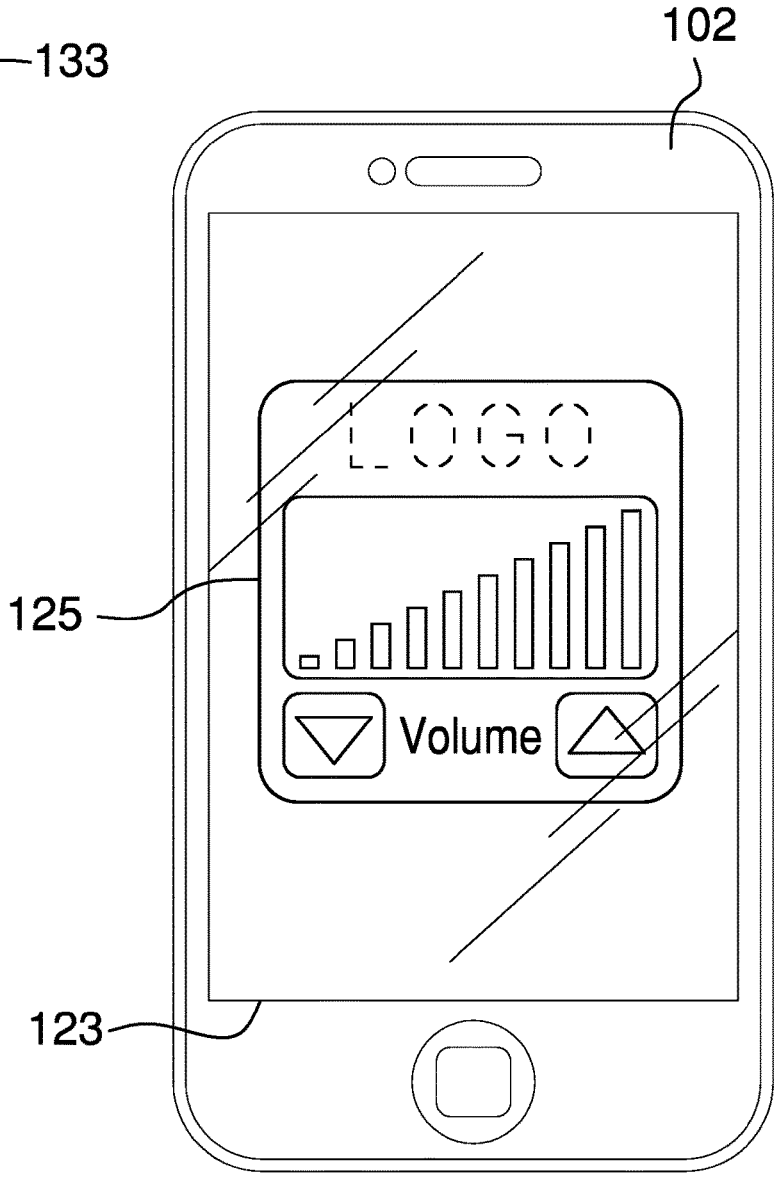
FIG. 5 is a detail view of an embodiment of the disclosure.
Figure 6:
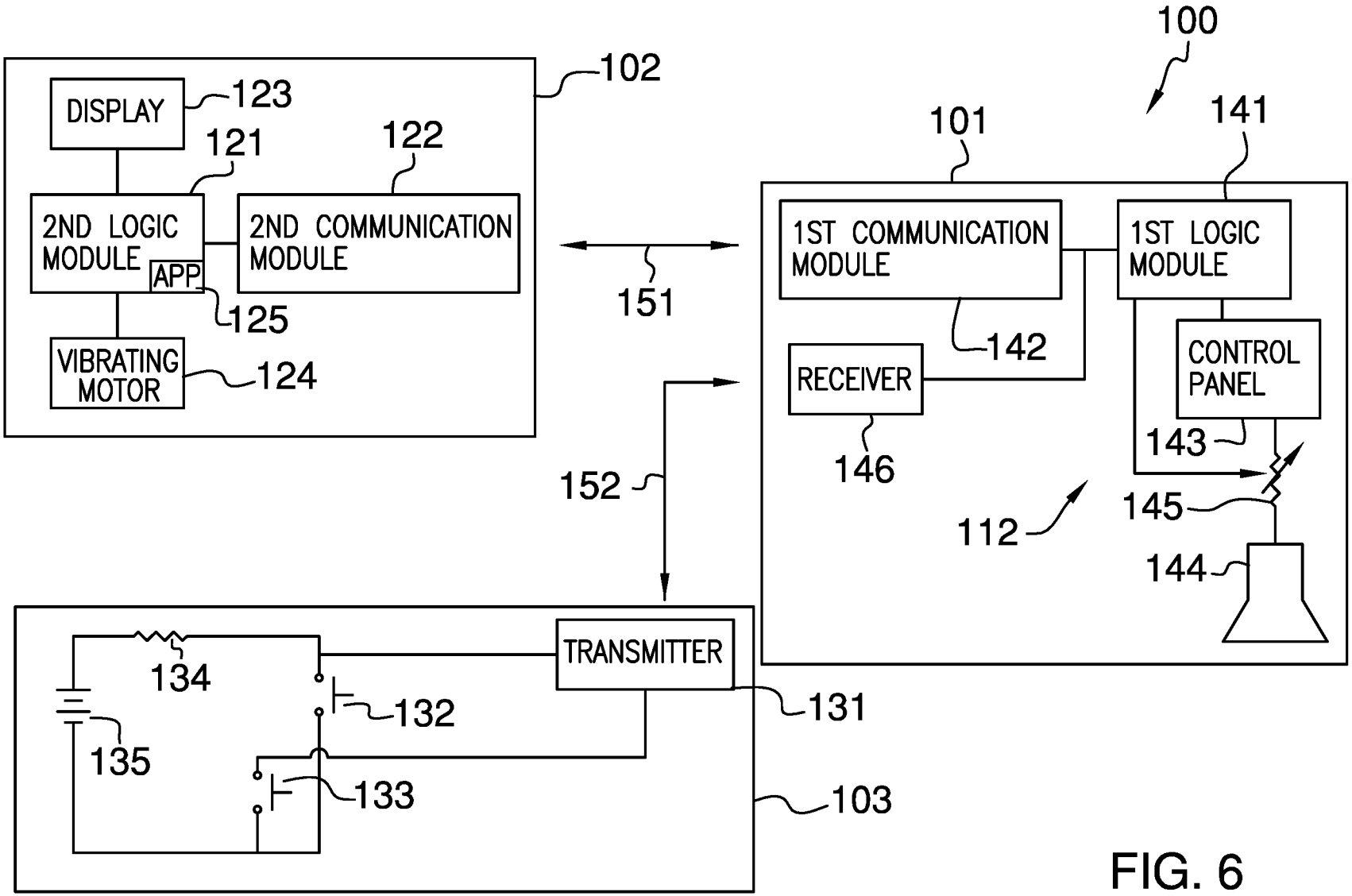
FIG. 6 is a block diagram of an embodiment of the disclosure.

Detailed reference will now be made to one or more potential embodiments of the disclosure, which are illustrated in FIGS. 1 through 6.

The improved microwave oven 100 (hereinafter invention) comprises modifications made to a microwave oven 101 to reduce the noise generated by the microwave oven 101. The modifications made to the invention 100 include: 1) adding a volume control to the control system 112 of the microwave oven 101 to reduce volume of the sounds generated by the microwave oven 101; 2) adding a pneumatic latch 111 to the microwave oven 101 to reduce the noise generated by the opening and closing of the microwave oven 101 door 113; and, 3) providing remote control 103 capability to the microwave oven 101 such that the operation of the microwave oven 101 can be handled remotely from a more noise tolerant environment. The invention 100 comprises the microwave oven 101, a personal data device 102, and a remote control 103. The personal data device 102 operates the microwave oven 101 from a remote location. The remote control 103 controls the volume of the sounds generated by the microwave oven 101 from a remote location.

The microwave oven 101 is well-known and documented cooking device. The microwave oven 101 generates electromagnetic radiation used for heating foodstuffs. The wavelength of the electromagnetic radiation generated by the microwave oven 101 is approximately 12 cm. The microwave oven 101 further comprises a pneumatic latch 111, a control system 112, and a microwave oven 101 door 113.

The main sources of acoustic noise from a microwave oven 101 include, but are not limited to: 1) the opening and closing of the microwave oven 101 door 113; 2) the audible alerts generated by the control system 112 of the microwave oven 101; and, 3) the fan that cools the magnetron. The magnetron is the device that generates the electromagnetic radiation of the microwave oven 101. This disclosure will focus on minimizing the sounds generated by the microwave oven 101 door 113 and the alerts generated by the control system 112.

The microwave oven 101 door 113 is a barrier that controls access to the interior of the microwave oven 101 door 113. The pneumatic latch 111 is a commercially available pneumatic door damper. Specifically, the pneumatic latch 111 provides a shock absorbing buffer that: 1) prevents the microwave oven 101 door 113 from being slammed closed; while, 2) not interfering with the safety interlocks that prevent the generation of electromagnetic radiation by the microwave oven 101 while the microwave oven 101 door 113 is open.

The control system 112 is an electronic device that controls the operation of the microwave oven 101. The control system 112 comprises a first logic module 141, a first communication module 142, a control panel 143, a speaker 144, a volume control 145, a receiver 146, a local volume increase switch 147, and a local volume decrease switch 148.

The first logic module 141 is a readily and commercially available programmable electronic device that is used to manage, regulate, and operate the control system 112. Depending on the specific design and the selected components, the first logic module 141 can be a separate component within the control system 112 or the functions of the first logic module 141 can be incorporated into another component within the control system 112.

The first communication module 142 is a wireless electronic communication device that allows the first logic module 141 to communicate with the personal data device 102 wirelessly. Specifically, the first communication module 142 establishes a first wireless communication link 151 between the control system 112 and the personal data device 102. The first wireless communication link 151 is a wireless communication channel between the microwave oven 101 and the personal data device 102. In the first potential embodiment of the disclosure, the first communication module 142 supports a communication protocol selected from the group consisting of a WiFi protocol or a Bluetooth protocol.

The control panel 143 forms the master interface between the user and the control system 112 of the microwave oven 101. The speaker 144 refers to a commercially available transducer that generates audible sounds based on electrical signals generated by the control system 112.

The volume control 145 is an electrical device that is controlled by the first logic module 141. The volume control 145 is selected from the group consisting of a resistive device, such as a potentiometer, or an amplifying device, such as a transistor. The volume control 145 controls the amplitude of the electrical signals that are used to drive the speaker 144. The use of electrical circuits to control the volume through a speaker 144 is well-known and documented in the electrical arts.

The receiver 146 is the device within the control system 112 that: 1) establishes the second wireless communication link 152 with the transmitter 131 of the remote control 103; and, 2) transfers the signals received over the second wireless communication link 152 to the first logic module 141 for processing. The receiver 146 and the transmitter 131 are readily and commercially available electrical devices.

The local volume increase switch 147 is a normally open momentary switch that instructs the first logic module 141 to increase the volume of the speaker 144. The local volume decrease switch 148 is a normally open momentary switch that instructs the first logic module 141 to decrease the volume of the speaker 144.

The personal data device 102 is a programmable logical device that provides data management and communication services through one or more functions referred to as an application 125. The application 125 is a set of logical operating instructions that are performed by the personal data device 102. The addition of an application 125 will provide increased functionality for the personal data device 102. This disclosure assumes that an application 125 has been developed to interact with the invention 100. Methods to design and implement an application 125 on a personal data device 102 are well known and documented in the electrical arts. The personal data device 102 comprises a second logic module 121, a second communication module 122, a display 123, a vibrating motor 124, and an application 125.

The second logic module 121 is a readily and commercially available programmable electronic device used to manage, regulate, and operate the personal data device 102. Depending on the specific design and the selected components, the second logic module 121 can be a separate component within the personal data device 102 or the functions of the second logic module 121 can be incorporated into another component within the personal data device 102.

The second communication module 122 is a wireless electronic communication device that allows the second logic module 121 to communicate with microwave oven 101 wirelessly. Specifically, the second communication module 122 establishes the first wireless communication link 151 between the personal data device 102 and the microwave oven 101. In the first potential embodiment of the disclosure, the second communication module 122 supports a communication protocol selected from the group consisting of a WiFi protocol or a Bluetooth protocol.

The display 123 is a commercially available touchscreen display that is controlled by the second logic module 121 and that is operated by the application 125. The display 123 comprises touchscreen technology used as an interface between the application 125 and the user. The image projected on the display 123 is configured to display a series of options that allow the user to make the selections necessary to remotely operate the microwave oven 101.

The vibrating motor 124 is a commercially available vibration motor that is used to vibrate the personal data device 102. The use of the vibrating motor 124 allows for the silent remote operation of the microwave oven 101. The vibrating motor 124 is controlled by the second logic module 121 under the supervision of the application 125.

The application 125 is a series of previously determined instructions that: 1) receives operating instructions regarding the microwave oven 101 from the display 123; and, 2) transmits the received instructions for implementation in the microwave oven 101 by the control system 112. Among the functions supported by the personal data device 102 is the ability to increase and decrease the volume of alerts generated by the control panel 143 of the microwave oven 101.

The remote control 103 is an electronic device that transmits signals to the control system 112 of the microwave oven 101. The remote control 103 is configured to transmit electronic signals that increase and decrease the volume of the alerts generated by the control system 112 through the control panel 143. The remote control 103 comprises a transmitter 131, a remote volume increase switch 132, a remote volume decrease switch 133, a limit resistor 134, and a battery 135.

The transmitter 131 is a radio frequency transmitter 131 operated by both the remote volume increase switch 132 and the remote volume decrease switch 133. The transmitter 131 establishes a second wireless communication link 152 with the receiver 146 of the control system 112 such that the remote control 103 can send instructions from the remote control 103 to the microwave oven 101 to increase and decrease the alert volume of the microwave oven 101. The second wireless communication link 152 is a wireless communication channel between the microwave oven 101 and the remote control 103.

The remote volume increase switch 132 is a normally open momentary switch that initiates a signal from the transmitter 131 to the receiver 146 to initiate the control system 112 to increase the alert volume. The remote volume decrease switch 133 is a normally open momentary switch that initiates a signal from the transmitter 131 to the receiver 146 to initiate the control system 112 to decrease the alert volume.

The limit resistor 134 is a commercially available resistor that is used to limit the current flow through the remote volume increase switch 132 and the remote volume decrease switch 133. The battery 135 is a commercially available chemical device that is used to power the remote control 103.

The following definitions were used in this disclosure:

Application or App: As used in this disclosure, an application or app is a self-contained piece of software that is specially designed or downloaded for use with a personal data device.

Battery: As used in this disclosure, a battery is a chemical device consisting of one or more cells, in which chemical energy is converted into electricity and used as a source of power.

Control System: As used in this disclosure, a control system is a first device or system that manages and regulates the behavior or operation of a second device or system.

Display: As used in this disclosure, a display is a surface upon which is presented an image, potentially including, but not limited to, graphic images and text, that is interpretable by an individual viewing the projected image in a meaningful manner.

Electric Motor: In this disclosure, an electric motor is a machine that converts electric energy into rotational mechanical energy.

Fluid: As used in this disclosure, a fluid refers to a state of matter wherein the matter is capable of flow and takes the shape of a container it is placed within. The term fluid commonly refers to a liquid or a gas.

Handheld: As used in this disclosure, when referring to an item or device, handheld means that the item or device is small and light enough to be operated while a person holds the item or device in their hands.

Interface: As used in this disclosure, an interface is a physical or virtual boundary that separates two different systems across which information is exchanged.

Interlock: As used in this disclosure, an interlock is a device that disables the operation of a first mechanism without use of a second mechanism. Generally, an interlock is used as a safety device.

Latch: As used in this disclosure, a latch is a fastening or locking mechanism. The use of the term latch does not necessarily but often implies the insertion of an object into a notch or cavity.

Limit Resistor: As used in this disclosure, a limit resistor is an electrical resistor that is used to limit the flow of electric current through an electrical circuit.

Logic Module: As used in this disclosure, a logic module is a readily and commercially available electrical device that is programmable and that accepts digital and analog inputs, processes the digital and analog inputs according to previously stored instruction and provides the results of these instructions as digital or analog outputs.

Logical Device: As used in this disclosure, a logical device is a programmable electrical device that processes externally provided inputs to generate outputs that are determined from a previously programmed set of instructions.

Momentary Switch: As used in this disclosure, a momentary switch is a biased switch in the sense that the momentary switch has a baseline position that only changes when the momentary switch is actuated (for example when a pushbutton switch is pushed). The momentary switch then returns to the baseline position once the actuation is completed. This baseline position is called the "normal" position. For example, a "normally open" momentary switch interrupts (open) the electric circuit in the baseline position and completes (closes) the circuit when the momentary switch is activated. Similarly, a "normally closed" momentary switch will complete (close) an electric circuit in the baseline position and interrupt (open) the circuit when the momentary switch is activated.

Motor: As used in this disclosure, a motor refers to the method of transferring energy from an external power source into mechanical energy.

PDD: As used in this disclosure, PDD is an acronym for a personal data device.

Personal Data Device: As used in this disclosure, a personal data device is a handheld logical device used for managing personal information and communication. Examples of personal data device include, but are not limited to, cellular phones, tablets, and smartphones.

Pneumatic: As used in this disclosure, pneumatic refers to a device wherein the movement of the device is powered using a fluid under pressure.

Potentiometer: As used in this disclosure, a potentiometer is an adjustable electrical device that presents a resistance to a voltage. The level of resistance is adjustable.

Remote Control: As used in this disclosure, remote control means the establishment of control of a device from a distance. Remote control is generally accomplished through the use of an electrical device that generates electrically based control signals that are transmitted via radio frequencies or other means to the device.

Resistor: As used in this disclosure, a resistor is a well-known and commonly available electrical device that inhibits the flow of electricity through an electric circuit. Within an electric circuit processing alternating currents, the resistor will not affect the phase of the alternating current. A current flowing through a resistor will create a voltage across the terminals of the resistor.

Speaker: As used in this disclosure, a speaker is an electrical transducer that converts an electrical signal into an audible sound.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Tradition: As used in this disclosure, a tradition refers to: 1) a set of thoughts or expectations regarding a subject or object; or, 2) a method of using an object; that, 3) is perceived to be widely or commonly shared across a population of people; and that, 4) is perceived to be widely or commonly shared across at least two generations within the population of people.

Transducer: As used in this disclosure, a transducer is a device that converts a physical quantity, such as pressure or brightness into an electrical signal or a device that converts an electrical signal into a physical quantity.

Transistor: As used in this disclosure, a transistor is a general term for a three-terminal semiconducting electrical used for electrical signal amplification and electrical switching applications. There are several designs of transistors. A common example of a transistor is an NPN transistor that further comprises a collector terminal, an emitter terminal, and a base terminal and which consists of a combination of two rectifying junctions (a diode is an example of a rectifying junction). Current flowing from the collector terminal through the emitter terminal crosses the two rectifier junctions. The amount of the electric current crossing the two rectified junctions is controlled by the amount of electric current that flows through the base terminal.

Vibration Motor: As used in this disclosure, a vibration motor is an electric motor that rotates an unbalanced weight in such a manner that the electric motor vibrates during operation. The vibration can be varied by varying the rotational speed of the vibration motor. The rotational speed is varied by varying the electric current flowing through the vibration motor.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A cooking device comprising:

a microwave oven, a personal data device, and a remote control;

wherein the personal data device operates the microwave oven from a remote location;

wherein the remote control controls the volume of the sounds generated by the microwave oven from a remote location;

wherein the cooking device comprises a volume control to reduce the noise generated by the microwave oven;

wherein the cooking device comprises a device to reduce the noise generated by the opening and closing of the microwave oven door;

wherein the microwave oven further comprises a pneumatic latch, a control system, and a microwave oven door;

wherein the pneumatic latch, the control system, and the microwave oven door attach to the microwave oven;

wherein the microwave oven door is a barrier that controls access to the interior of the microwave oven door;

wherein the pneumatic latch is a pneumatic door damper;

wherein the pneumatic latch prevents the microwave oven door from being slammed closed;

wherein the pneumatic latch does not interfere with one or more safety interlocks that prevent the generation of electromagnetic radiation by the microwave oven while the microwave oven door is open;

wherein the control system is an electronic device;

wherein the control system controls the operation of the microwave oven;

wherein the control system comprises a first logic module, a first communication module, a control panel, a speaker, the volume control, a receiver, a local volume increase switch, and a local volume decrease switch;

wherein the first logic module, the first communication module, the control panel, the speaker, the volume control, the receiver, a local volume increase switch, and a local volume decrease switch are electrically interconnected.

2. The cooking device according to claim 1 wherein the first logic module is a programmable electronic device;

wherein the first communication module is a wireless electronic communication device that allows the first logic module to communicate with the personal data device wirelessly.

3. The cooking device according to claim 2 wherein the first communication module establishes a first wireless communication link between the control system and the personal data device.

4. The cooking device according to claim 3 wherein the control panel forms the master interface with the control system of the microwave oven;

wherein the speaker is a transducer that generates audible sounds based on electrical signals generated by the control system.

5. The cooking device according to claim 4 wherein the volume control is an electrical device that is controlled by the first logic module;

wherein the volume control controls the amplitude of the electrical signals that are used to drive the speaker.

6. The cooking device according to claim 5 wherein the receiver establishes a second wireless communication link with the remote control;

wherein the receiver transfers the signals received over the second wireless communication link to the first logic module for processing.

7. The cooking device according to claim 6 wherein the local volume increase switch is a normally open momentary switch;

wherein the local volume decrease switch is a normally open momentary switch.

8. The cooking device according to claim 7 wherein the personal data device comprises a second logic module, a second communication module, a display, a vibrating motor, and an application;

wherein the second logic module, the second communication module, the display, and the vibrating motor are electrically interconnected;

wherein the application is a series of previously determined instructions that receives operating instructions regarding the microwave oven from the display;

wherein the application is a series of previously determined instructions that initiates the transmission of the received instructions to the microwave oven.

9. The cooking device according to claim 8 wherein the second logic module is a programmable electronic device;

wherein the second communication module is a wireless electronic communication device;

wherein the second communication module establishes the first wireless communication link between the personal data device and the microwave oven.

10. The cooking device according to claim 9 wherein the display is a touchscreen display that is controlled by the second logic module and that is operated by the application;

wherein the image projected on the display is configured to display a series of options providing the selections necessary to remotely operate the microwave oven.

11. The cooking device according to claim 10 wherein the vibrating motor is a vibration motor;

wherein the second logic module controls the vibrating motor under the supervision of the application.

12. The cooking device according to claim 11 wherein the remote control is an electronic device that transmits signals to the control system of the microwave oven;

wherein the remote control is configured to transmit electronic signals that increase and decrease the volume of the alerts generated by the control system through the control panel.

13. The cooking device according to claim 12 wherein the remote control comprises a transmitter, a remote volume increase switch, a remote volume decrease switch, a limit resistor, and a battery;

wherein the transmitter, the remote volume increase switch, the remote volume decrease switch, the limit resistor, and the battery are electrically interconnected.

14. The cooking device according to claim 13 wherein the transmitter is a radio frequency transmitter operated by both the remote volume increase switch and the remote volume decrease switch;

wherein the transmitter establishes the second wireless communication link with the receiver of the control system such that the remote control can send instructions from the remote control to the microwave oven to increase and decrease the alert volume of the microwave oven.

15. The cooking device according to claim 14 wherein the remote volume increase switch is a normally open momentary switch;

wherein the remote volume decrease switch is a normally open momentary switch;

wherein the limit resistor is a resistor used to limit the current flow through the remote volume increase switch and the remote volume decrease switch;

wherein the battery is a chemical device that powers the remote control.

16. The cooking device according to claim 15 wherein the volume control is selected from the group consisting of a resistive device and an amplifying device.

* * * * *